US009402475B2

(12) United States Patent
Gu et al.

(10) Patent No.: US 9,402,475 B2
(45) Date of Patent: Aug. 2, 2016

(54) MOUNTING APPARATUS FOR SLIDE RAIL

(71) Applicant: ShenZhen Goldsun Network Intelligence Technology Co., Ltd., Shenzhen (CN)

(72) Inventors: Guang-Hua Gu, Shenzhen (CN); Wen-Feng Hu, Shenzhen (CN); Wu-Qiang Huang, Shenzhen (CN)

(73) Assignee: ShenZhen Goldsun Network Intelligence Technology Co., Ltd., ShenZhen (CN)

( * ) Notice: Subject to any disclaimer, the term of this patent is extended or adjusted under 35 U.S.C. 154(b) by 473 days.

(21) Appl. No.: 13/965,186

(22) Filed: Aug. 12, 2013

(65) Prior Publication Data

US 2014/0186106 A1 Jul. 3, 2014

(30) Foreign Application Priority Data

Dec. 29, 2012 (CN) ..... 2012 1 05891484

(51) Int. Cl.
*A47B 88/04* (2006.01)

(52) U.S. Cl.
CPC ..... *A47B 88/044* (2013.01); *Y10T 403/602* (2015.01)

(58) Field of Classification Search
CPC ..... A47B 88/0418; A47B 88/0055; A47B 96/00; A47B 88/0444; A47B 88/0422; A47B 88/0425; A47B 88/0429; A47B 88/0433; A47B 88/0437; A47B 57/00; A47B 47/00; A47B 57/30; H05K 7/1489; H05K 7/1421; Y10T 403/59; Y10T 403/595; Y10T 403/599; Y10T 403/60; Y10T 403/602; Y10T 403/408
USPC ..... 403/327, 328, 326, 330, 81, 188, 194, 403/DIG. 12; 312/348.4, 334.4, 334.5, 312/334.8; 211/26, 189–192; 248/220.21, 248/220.31, 220.43, 222.11, 222.13, 248/222.12, 298.1, 241, 235, 222.41, 248/223.41
See application file for complete search history.

(56) References Cited

U.S. PATENT DOCUMENTS

| | | | | | |
|---|---|---|---|---|---|
| 5,056,954 | A * | 10/1991 | Flux | F16B 1/00 | 24/114.5 |
| 6,773,080 | B2 * | 8/2004 | Chen | A47B 57/40 | 211/26 |
| 7,144,184 | B1 * | 12/2006 | Tsai | A47B 88/044 | 211/192 |
| 8,727,138 | B2 * | 5/2014 | Dittus | H05K 7/1489 | 211/26 |
| 9,125,489 | B2 * | 9/2015 | Chen | A47B 88/044 | |
| 2003/0106863 | A1 * | 6/2003 | Lauchner | A47B 88/044 | 211/26 |
| 2003/0234602 | A1 * | 12/2003 | Cutler | A47B 88/044 | 312/333 |
| 2005/0156493 | A1 * | 7/2005 | Yang | H05K 7/1489 | 312/334.5 |
| 2005/0206285 | A1 * | 9/2005 | Greenwald | H05K 7/1421 | 312/334.5 |
| 2008/0087781 | A1 * | 4/2008 | Chen | A47B 88/044 | 248/224.8 |

(Continued)

*Primary Examiner* — Joshua J Michener
*Assistant Examiner* — Theodore Adamos
(74) *Attorney, Agent, or Firm* — ScienBiziP, P.C.

(57) ABSTRACT

A mounting apparatus for mounting a slide rail to either a first bracket or a second bracket includes a retaining member, a first locking member pivotably attached to the retaining member, and a second locking member pivotably attached to the first locking member. The retaining member includes a sidewall forming a positioning pole. The positioning pole includes a first positioning portion and a second positioning portion. When mounting the slide rail to the first bracket, the first positioning portion engages in a through hole of the first bracket, a first abutting portion abuts against the first bracket. When mounting the slide rail to the second bracket, the second positioning portion engages in a through hole of the second bracket, a second abutting portion and the first abutting portion engage with the second bracket.

15 Claims, 6 Drawing Sheets

(56) References Cited

U.S. PATENT DOCUMENTS

2008/0203251 A1* 8/2008 Chen ..... H05K 7/1489 248/200
2008/0230496 A1* 9/2008 Henderson ..... H05K 7/1489 211/26
2009/0114785 A1* 5/2009 Huang ..... H05K 7/1489 248/220.31
2009/0166485 A1* 7/2009 Chen ..... A47B 88/044 248/200
2012/0134743 A1* 5/2012 Yu ..... A47B 88/044 403/330
2012/0193489 A1* 8/2012 Yu ..... H05K 7/1489 248/201
2013/0020452 A1* 1/2013 Yu ..... H05K 7/1489 248/220.21

* cited by examiner

MOUNTING APPARATUS FOR SLIDE RAIL

BACKGROUND

1. Technical Field

The disclosure relates to mounting apparatuses, and more particularly to a mounting apparatus for mounting a slide rail.

2. Description of Related Art

A slide rail is used between two objects that can move relative to each other, such as between a desk and a drawer, or a server and a rack. A conventional slide rail assembly for a drawer and a desk includes an outer slide rail mounted to the desk, an inner slide rail mounted to the drawer, and an intermediate slide rail mounted between the outer and inner slide rails. The intermediate slide rail is extendable relative to the outer slide rail, and the inner slide rail is extendable relative to the intermediate slide rail, thus the drawer can be extended a short distance out from the desk. A plurality of screws is used for mounting the outer slide rail to the desk. Therefore, installing or uninstalling the outer slide rail to or from the desk is inconvenient and time-consuming.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
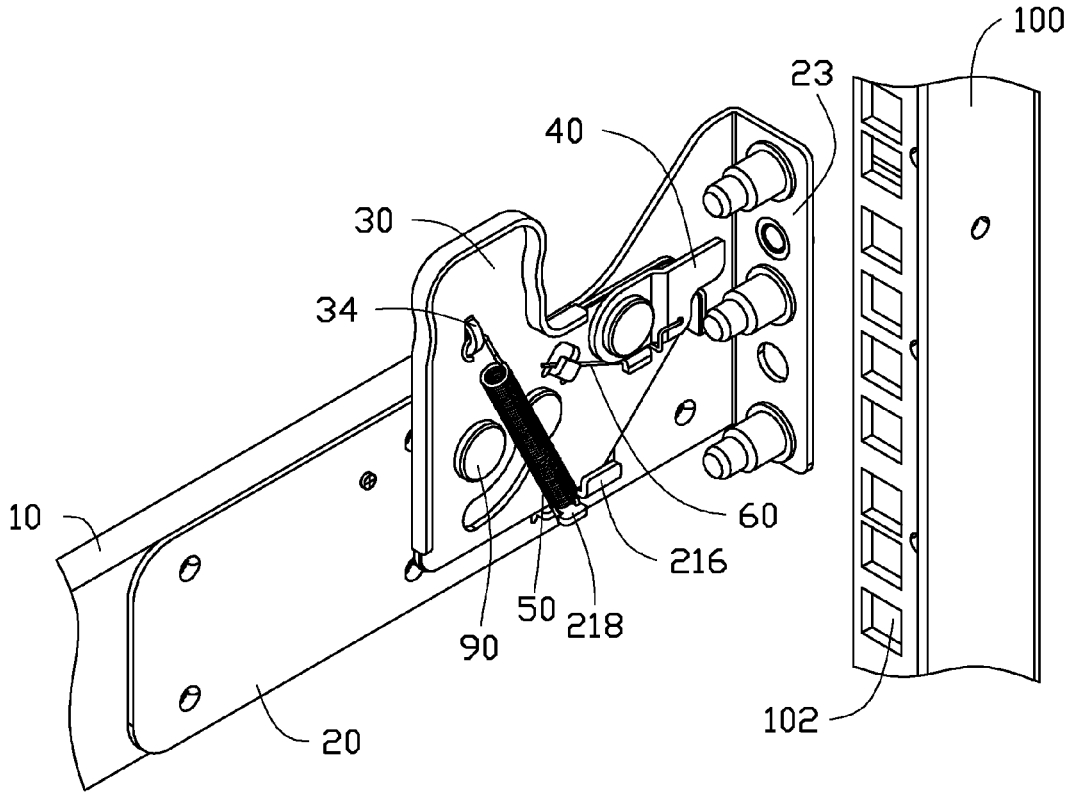
FIG. 1 is an assembled, isometric view of an embodiment of a mounting apparatus for a slide rail, together with a first bracket.
Figure 2:
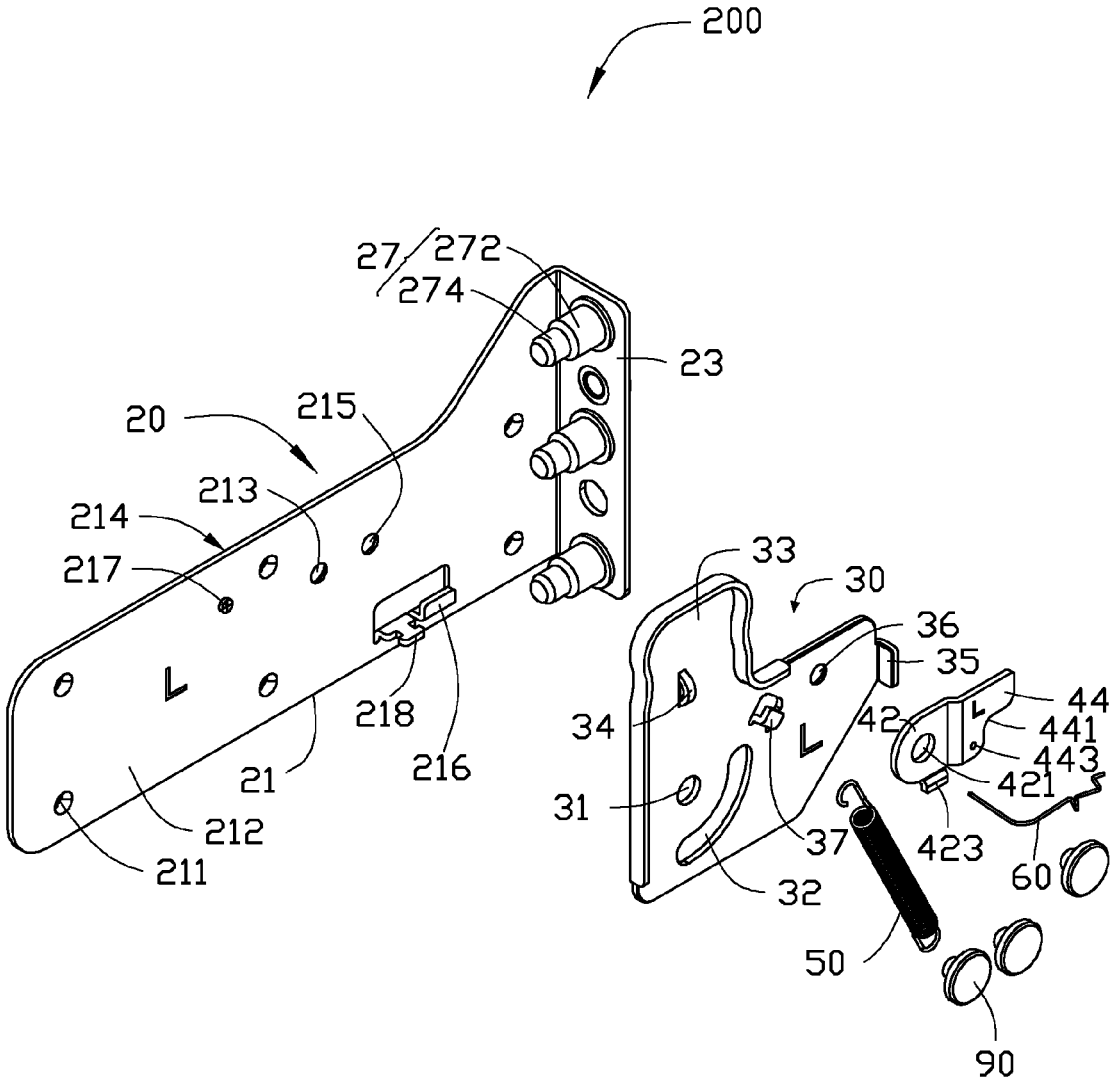
FIG. 2 is an exploded, isometric view of the mounting apparatus of FIG. 1.

FIGS. 1 and 2 show an embodiment of a mounting apparatus 200. The mounting apparatus 200 is used for mounting a slide rail 10 to a first bracket 100. The mounting apparatus 200 includes a retaining member 20, a first locking member 30, a second locking member 40, a first resilient member 50, and a second resilient member 60.

The first bracket 100 defines a plurality of rectangular through holes 102 from top to bottom.

The retaining member 20 is substantially L-shaped, and includes a main wall 21, and a sidewall 23 substantially perpendicularly extending from one end of the main wall 21. The main wall 21 includes a first surface 212 and a second surface 214 opposite to the first surface 212. The main wall 21 defines a plurality of mounting holes 211, for mounting the retaining member 20 to an end of the slide rail 10. The main wall 21 defines a first fixing hole 213 and a second fixing hole

215 in a middle of the main wall 21. An L-shaped first limiting portion 216 and a columnar second limiting portion 217 respectively protruding from the first surface 212 adjacent to the lower edge and the upper edge of the main wall 21,. An H-shaped projection 218 is formed on the first surface 212 and adjacent to the first limiting portion 216. A plurality of positioning poles 27 extend inward from the sidewall 23. Each positioning pole 27 is substantially stepped and includes a round first positioning portion 272 extending from the sidewall 23, and a round second positioning portion 274 axially extending from a distal end of the first positioning portion 272. A diameter of the first positioning portion 272 is greater than a diameter of the second positioning portion 274.

The first locking member 30 is substantially L-shaped and defines a pivot hole 31 in a corner of the first locking member 30 and an arc-shaped slide slot 32 around the pivot hole 31. An operation portion 33 is formed on a first side of the first locking member 30 above the pivot hole 31. A bridge shaped raised portion 34 protrudes on the first locking member 30 adjacent to the operation portion 33. A first abutting portion 35 is formed on a second side of the first locking member 30 opposite to the pivot hole 31. A connecting hole 36 is defined in the first locking member 30, adjacent to the first abutting portion 35. An L-shaped tab 37 is formed on the first locking member 30, between the connecting hole 36 and the slide slot 32.

The second locking member 40 includes a pivot portion 42 and a second abutting portion 44. The pivot portion 42 defines a pivot hole 421 in a center. A blocking portion 423 is formed at a bottom of the pivot portion 42. A cutout 441 is defined in a bottom edge of the second abutting portion 44. A through hole 443 is defined the second abutting portion 44 adjacent to the pivot portion 42.

In this embodiment, the first resilient member 50 is a coil spring. The second resilient member 60 is a resilient metal wire.

Figure 3:
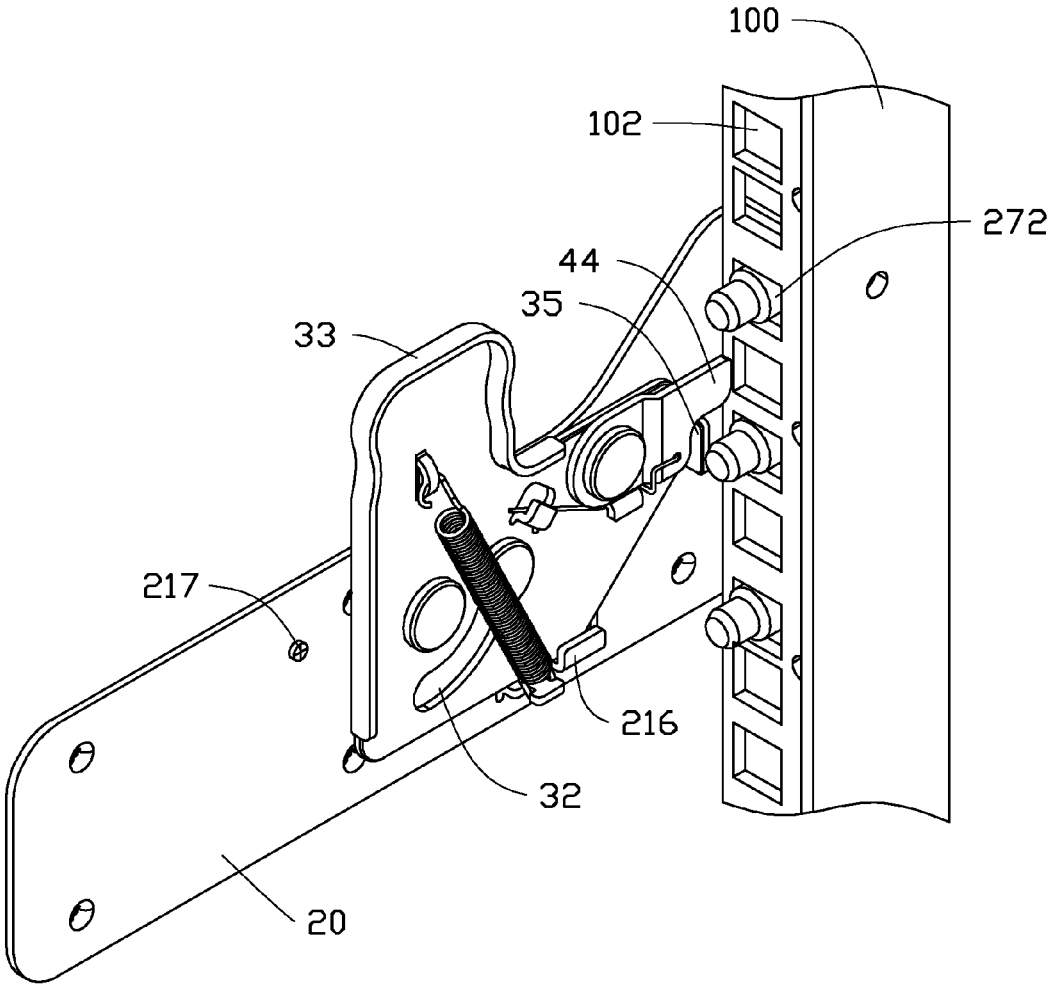
FIG. 3 is an assembled, isometric view of FIG. 1.
Figure 4:
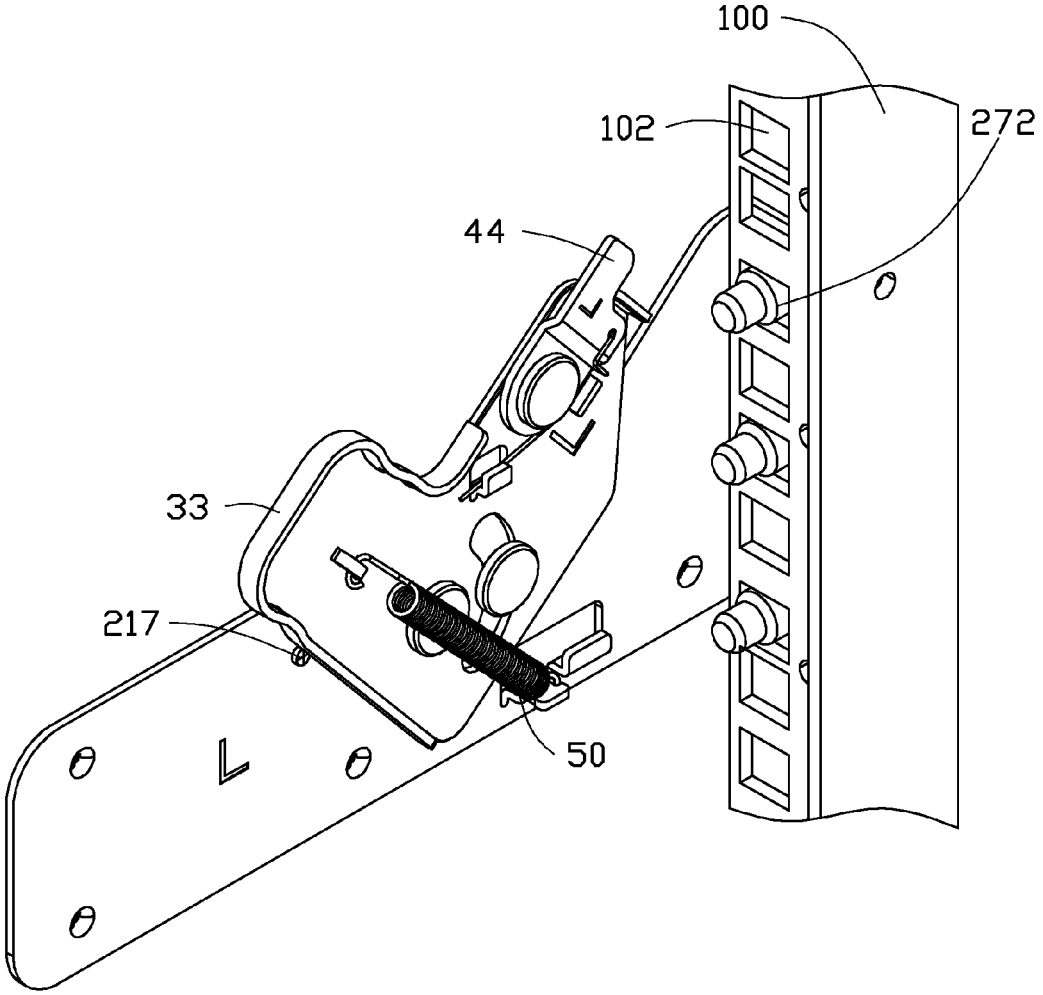
FIG. 4 is an assembled, isometric view of FIG. 1, showing another state of use.

FIGS. 3 and 4 show that in assembly, a rivet 90 extends through the pivot hole 31 to engage in the first fixing hole 213, pivotably attaching the first locking member 30 to the first surface 212 of the retaining member 20. A rivet 90 slidably extends through the slide slot 32 engaging in the second fixing hole 215. The first limiting portion 216 and the second limiting portion 217 are used for limiting a rotation angle of the first locking member 30. Opposite ends of the first resilient member 50 are locked to the raised portion 34 and the projection 218. A rivet 90 extends through the pivot hole 421 to engage in the connecting hole 36, to pivotably attach the second locking member 40 to the first locking member 30. A first end of the second resilient member 60 engages in the through hole 443, and a second end of the second resilient member 60 abuts against the tab 37. A middle portion of the second resilient member 60 abuts against the blocking portion 423. The first abutting portion 35 is received in the cutout 441 and abuts against a bottom of the second abutting portion 44.

In mounting the slide rail 10 to the first bracket 100, the operation portion 33 is operated to rotate the first locking member 30. The first abutting portion 35 moves up. The first positioning portions 272 engage in the corresponding through holes 102 of the first bracket 100 from a first side of the first bracket 100. The sidewall 23 abuts against the first side of the first bracket 100. The operation portion 33 is released. The first resilient member 50 is restored, and the first locking member 30 is rotated back, until a bottom of the first locking member 30 engages with the first limiting portion 216. The second resilient member 60 biases the second resisting portion 44 to abut against a second side of the first bracket 100 opposite to the first side of the first bracket 100, to avoid the first positioning portions 272 releasing from the though holes 102 of the first bracket 100.

In releasing the slide rail 10 from the first bracket 100, the operating portion 33 is operated to rotate up the first abutting portion 35. The first abutting portion 35 moves up the second abutting portion 44, until the second abutting portion 44 is disengaged from the second side of the first bracket 100. The positioning poles 27 of the retaining member 20 are readily removed from the through holes 102 of the first bracket 100, to release the retaining member 20 from the first bracket 100.

Figure 5:
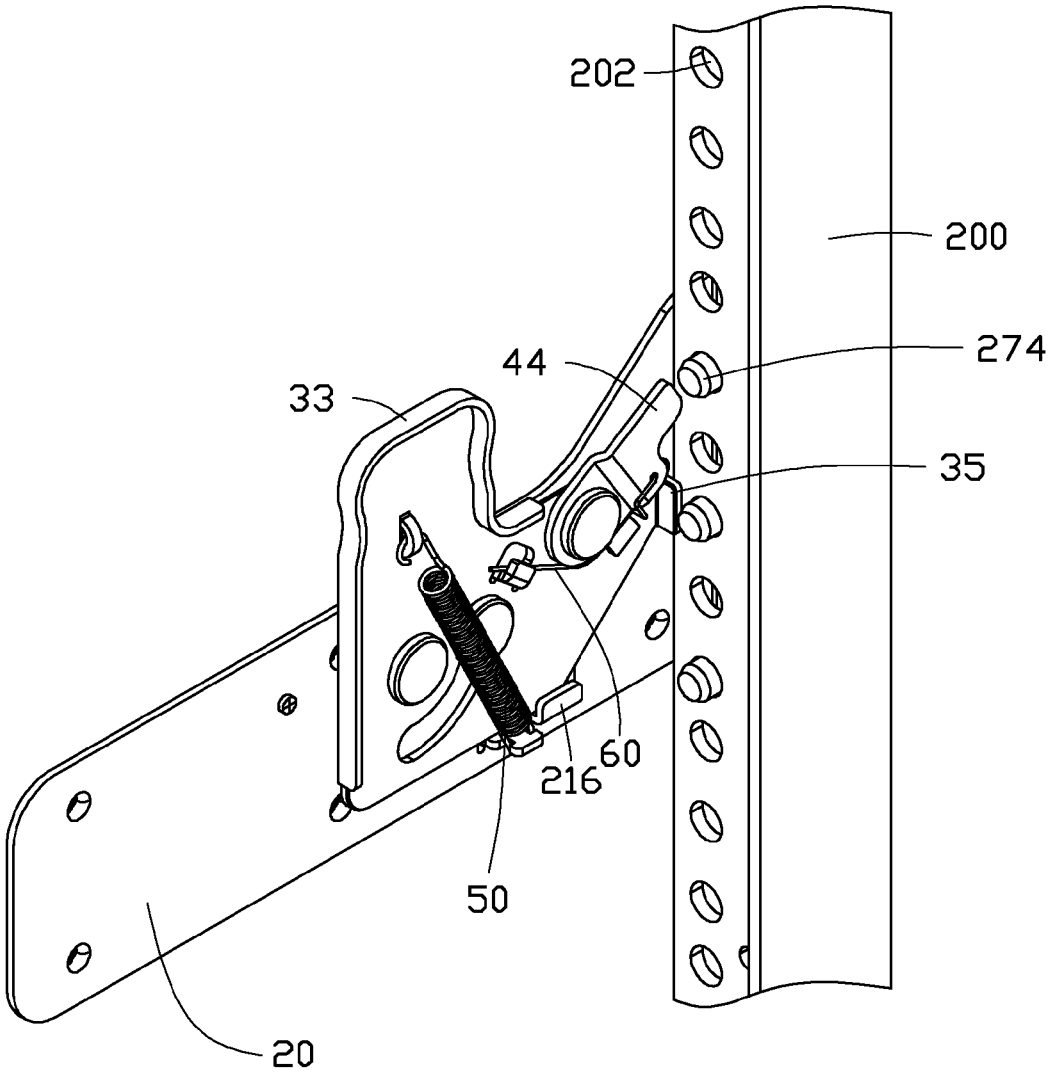
FIG. 5 is an assembled, isometric view of the mounting apparatus of FIG. 1, together with a second bracket.
Figure 6:
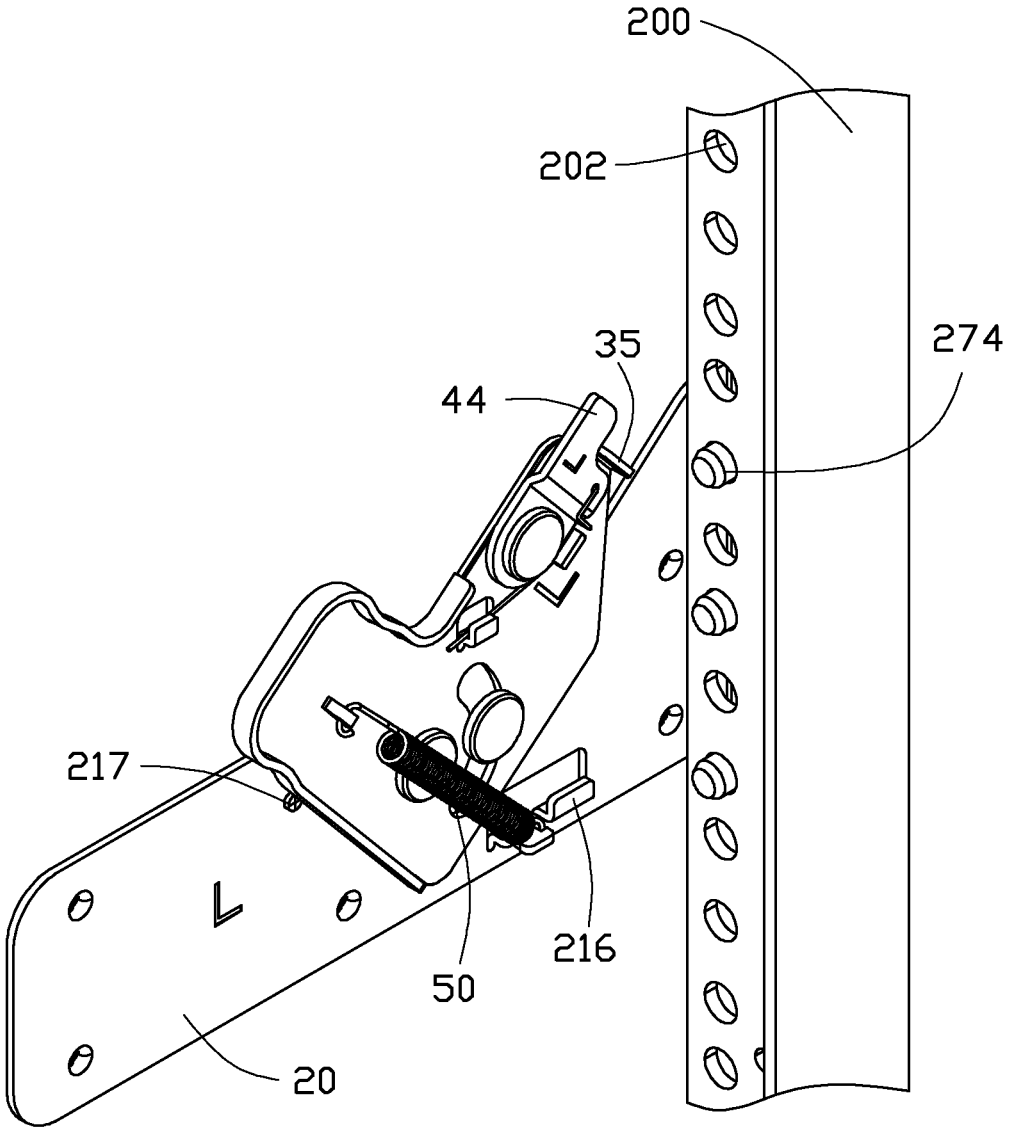
FIG. 6 is similar to FIG. 5, but showing another state of use.

FIGS. 5 and 6 show that in mounting the slide rail 10 to a second bracket 200, which defines a plurality of round through holes 202 (a diameter of the through hole 202 is less than a length of the through hole 102). The operation portion 33 is operated to rotate up the first abutting portion 35. The second positioning portions 274 engage in the corresponding through holes 202 of the second bracket 200 from a first side of the second bracket 200. The first positioning portions 274 abut against the first side of the second bracket 200. The operation portion 33 is released. The first resilient member 50 is restored, and the first locking member 30 is rotated back, until a bottom of the first locking member 30 engages with the first limiting portion 216. The first abutting portion 35 abuts against a second side of the second bracket 200 opposite to the first side of the second bracket 200, to evade the second positioning portions 274 from releasing the though holes 202 of the second bracket 200.

In releasing the slide rail 10 from the first bracket 100, the operation portion 33 is operated to rotate up the first abutting portion 35, until the first abutting portion 35 is disengaged from the second side of the second bracket 200. The second positioning poles 274 of the retaining member 20 are readily removed from the through holes 202 of the second bracket 200, to release the retaining member 20 from the second bracket 200.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A mounting apparatus for mounting a slide rail to a bracket, the bracket defines a plurality of through holes, the mounting apparatus comprising:

a retaining member comprising a main wall to be fixed to the slide rail, and a sidewall substantially perpendicularly extending from the main wall and away from the slide rail, a positioning portion extending from the sidewall, a first limiting portion and a projection extending from a lower portion of the main wall;

a first locking member pivotably mounted to the main wall and located at a same side of the main wall as the sidewall, wherein the first locking member comprises a first abutting portion and an operation portion formed at opposite sides of the first locking member, a raised portion protrudes from the first locking member and is adjacent to the operation portion; and a first resilient member, wherein opposite ends of the first resilient member are fixed to the projection and the raised portion, respectively;

wherein the positioning portion of the retaining member engages in a corresponding one of the plurality of through holes of the bracket from a first side of the bracket, the first abutting portion engages with a second side of the bracket opposite to the first side of the bracket, a bottom of the first locking member abuts against the first limiting portion; and wherein when releasing the slide rail from the bracket, the operating portion of the first locking member is operated to rotate up the first abutting portion and the first resilient member is deformed, to make the first abutting portion be disengaged from the second side of the bracket, thus, the positioning portion of the retaining member is readily to be removed from the corresponding one of the plurality of through holes of the bracket, to release the retaining member from the bracket.

2. The mounting apparatus as described in claim 1, further comprising a second locking member pivotably mounted to the first locking member and adjacent to the first abutting portion, the second locking member comprises a second abutting portion abutting against the second side of the bracket.

3. The mounting apparatus as described in claim 2, further comprising a second resilient member connected between the second locking member and the first locking member.

4. The mounting apparatus as described in claim 1, wherein the first locking member is substantially L-shaped and defines a pivot hole in a corner of the first locking member, a first rivet extends through the pivot hole of the first locking member to engage in the main wall, to pivotably attach the first locking member to the main wall.

5. The mounting apparatus as described in claim 4, wherein the first locking member defines an arc-shaped slide slot around the pivot hole, a second rivet slidably extends through the slide slot to engage in the main wall.

6. The mounting apparatus as described in claim 4, wherein a columnar second limiting portion protrudes on the main wall and adjacent to an upper edge of the main wall, the first locking member is pivotable about the first rivet relative to the main wall and is limited between the first limiting portion and the second limiting portion.

7. A mounting apparatus for mounting a slide rail to a bracket, the bracket defines a plurality of through holes, the mounting apparatus comprising:

a retaining member comprising a main wall to be fixed to the slide rail, and a sidewall substantially perpendicularly extending from the main wall and away from the slide rail, a positioning portion protruding on the sidewall, a first limiting portion and a projection extending from a lower portion of the main wall;

a first locking member pivotably mounted to the main wall and located at a same side of the main wall as the sidewall, wherein the first locking member comprises a first abutting portion and an operation portion formed at opposite sides of the first locking member, a raised portion protrudes from the first locking member and is adjacent to the operation portion;

a first resilient member, wherein opposite ends of the first resilient member are fixed to the projection and the raised portion, respectively;

a second locking member pivotably mounted to the first locking member and adjacent to the first abutting portion, the second locking member comprising a second abutting portion; and a second resilient member connected between the second locking member and the first locking member to bias the second abutting portion to tend to abut against the first abutting portion;

wherein when mounting the slide rail to the bracket, the positioning portion of the retaining member engages in a corresponding one of the plurality of through holes of the bracket from a first side of the bracket, the first resilient member biases the first locking member to make a bottom of the first locking member abut against the first limiting portion, the second resilient member biases the second abutting portion to abut against a second side of the bracket opposite to the first side of the bracket, to avoid the positioning portion releasing from the corresponding one of the plurality of through holes of the bracket; and wherein when releasing the slide rail from the bracket, the operation portion of the first locking member is operated to rotate up the first abutting portion and deform the first resilient member, the first abutting portion moves the second abutting portion to be disengaged from the second side of the first bracket, and the positioning portion of the retaining member is readily to be removed from the corresponding one of the plurality of through holes of the bracket, to release the retaining member from the bracket.

8. The mounting apparatus as described in claim 7, wherein the first locking member is substantially L-shaped and defines a pivot hole in a corner of the first locking member, a first rivet extends through the pivot hole of the first locking member to engage in the main wall, to pivotably attach the first locking member to the main wall.

9. The mounting apparatus as described in claim 8, wherein the first locking member defines an arc-shaped slide slot around the pivot hole, a second rivet slidably extends through the slide slot to engage in the main wall.

10. The mounting apparatus as described in claim 8, wherein a columnar second limiting portion protrudes on the main wall and adjacent to an upper edge of the main wall, the first locking member is pivotable about the first rivet relative to the main wall and is limited between the first limiting portion and the second limiting portion.

11. A mounting apparatus for mounting a slide rail to either a first bracket or a second bracket, the first bracket defines a plurality of first through holes, the second bracket defines a plurality of second through holes, the mounting apparatus comprising:

a retaining member comprising a main wall to be fixed to the slide rail, and a sidewall perpendicularly extending from the main wall and away from the slide rail, a positioning pole extending from the sidewall, the positioning pole comprising a first positioning portion extending from the sidewall and a second positioning portion protruding from a distal end of the first positioning portion, a first limiting portion and a projection extending from a lower portion of the main wall;

a first locking member pivotably mounted to the main wall and located at a same side of the main wall as the sidewall, wherein the first locking member comprises a first abutting portion and an operation portion formed at opposite sides of the first locking member, a raised portion protrudes from the first locking member and is adjacent to the operation portion;

a first resilient member, wherein opposite ends of the first resilient member are fixed to the projection and the raised portion, respectively;

a second locking member pivotably mounted to the first locking member and adjacent to the first abutting portion, the second locking member comprising a second abutting portion; and a second resilient member connected between the second locking member and the first locking member to bias the second abutting portion to tend to abut against the first abutting portion;

wherein when mounting the slide rail to the first bracket, the first positioning portion of the retaining member engages in a corresponding one of the plurality of first through holes of the first bracket from a first side of the first bracket, the first resilient member biases the first locking member to make a bottom of the first locking member abut against the first limiting portion, the second resilient member biases the second abutting portion to abut against a second side of the first bracket opposite to the first side of the first bracket, to avoid the first positioning portion releasing from the corresponding one of the plurality of first through holes of the first bracket; and wherein when releasing the slide rail from the first bracket, the operating portion of the first locking member is operated to rotate up the first abutting portion and deform the first resilient member, the second abutting portion is disengaged from the second side of the first bracket, and the first positioning portion of the retaining member is readily removed from the corresponding one of the plurality of first through holes of the first bracket, to release the retaining member from the first bracket;

wherein when mounting the slide rail to the second bracket, the second positioning portion of the retaining member engages in a corresponding one of the plurality of second through holes of the second bracket from a first side of the second bracket, the first positioning portion abuts against the first side of the second bracket, the first abutting portion and the second abutting portion engage with a second side of the second bracket opposite to the first side of the second bracket, a bottom of the first locking member abuts against the first limiting portion; and wherein when releasing the slide rail from the second bracket, the operation portion of the first locking member is operated to rotate up the first abutting portion and deform the first resilient member, to make the first abutting portion be disengaged from the second side of the second bracket, and the second positioning portion of the retaining member is readily removed from the corresponding one of the plurality of second through holes of the second bracket, to release the retaining member from the second bracket.

12. The mounting apparatus as described in claim 11, wherein a diameter of the first positioning portion is greater than a diameter of the second positioning portion.

13. The mounting apparatus as described in claim 11, wherein the first locking member is substantially L-shaped and defines a pivot hole in a corner of the first locking member, a first rivet extends through the pivot hole of the first locking member to engage in the main wall, to pivotably attach the first locking member to the main wall.

14. The mounting apparatus as described in claim 13, wherein the first locking member defines an arc-shaped slide slot around the pivot hole, a second rivet slidably extends through the slide slot to engage in the main wall.

15. The mounting apparatus as described in claim 13, wherein a columnar second limiting portion protrudes on the main wall and adjacent to an upper edge of the main wall, the first locking member is pivotable about the first rivet relative to the main wall and limited between the first limiting portion and the second limiting portion.

* * * * *